United States Patent [19]

van Mierlo

[11] Patent Number: 4,619,326

[45] Date of Patent: Oct. 28, 1986

[54] LINER HANGER WITH BRASS PACKER

[75] Inventor: Franciscus J. A. van Mierlo, Bakersfield, Calif.

[73] Assignee: Shell California Production Inc., Houston, Tex.

[21] Appl. No.: 725,077

[22] Filed: Apr. 19, 1985

[51] Int. Cl.[4] ..... E21B 43/10

[52] U.S. Cl. ..... 166/382; 166/115; 166/195; 166/208; 166/242

[58] Field of Search ..... 166/380–382, 166/206–208, 209, 242, 243, 217, 115, 74, 195; 285/302, 187; 277/236

[56] References Cited

U.S. PATENT DOCUMENTS

| | | | |
|---|---|---|---|
| Re. 14,756 | 11/1919 | Scott | 166/195 |
| 316,318 | 4/1885 | Wells | 166/181 |
| 1,079,690 | 11/1913 | Bowler et al. | 166/115 |
| 1,135,809 | 4/1915 | Jones | 166/242 |
| 1,411,486 | 4/1922 | Gallagher | 166/115 |
| 2,054,322 | 9/1936 | Hoferer | 166/195 |
| 2,125,231 | 7/1938 | Hurst | 166/195 |
| 2,644,532 | 7/1953 | Mater | 166/74 |
| 3,036,635 | 5/1962 | Corley, Jr. et al. | 166/242 |
| 3,325,176 | 6/1967 | Latham et al. | 277/236 |
| 3,347,319 | 10/1967 | Littlejohn | 166/242 |
| 3,399,548 | 9/1968 | Burns | 285/302 |
| 3,695,358 | 10/1972 | Blount et al. | 166/208 |
| 4,291,767 | 9/1981 | Hall, Jr. | 166/243 |

FOREIGN PATENT DOCUMENTS

| | | | |
|---|---|---|---|
| 769788 | 3/1957 | United Kingdom | 166/242 |

*Primary Examiner*—James A. Leppink

*Assistant Examiner*—Hoang C. Dang

[57] ABSTRACT

The present invention relates to an improved liner hanger adapter containing a tapered brass sleeve which is arranged to wedge into a section of reduced diameter casing and is connected above an expansion joint for accommodating the thermal expansion and contraction of a well liner such as a wire wrapped liner.

4 Claims, 5 Drawing Figures

LINER HANGER WITH BRASS PACKER

BACKGROUND OF THE INVENTION

The invention relates to an oil well liner hanger which provides a packer between the liner and a surrounding pipe string. More particularly, the invention relates to an erosion-resistant liner hanger for use in wells in which sand control is important.

Liner hangers with packers are described in U.S. patents such as U.S. Pat. Nos. 2,328,840; 2,916,092; 3,152,643; 3,342,268 and 3,468,375. As far as Applicant is aware, the previously used packer materials were limited to lead or deformable materials such as rubber-like materials.

SUMMARY OF THE INVENTION

The present invention relates to a well liner hanger capable of being mounted within a portion of a surrounding pipe string having an inner diameter small enough to engage and hold a sleeve which has passed through the other portions of the surrounding pipe string. The upper element of the hanger comprises a tube which (a) is fluid-tightly connected near its upper end to a surrounding sleeve having brass-like properties of ductility, strength and corrosion resistance at least about equalling those of brass composed of 70% copper and 30% zinc, and (b) has a tapered outer diameter arranged to be capable of passing through a surrounding pipe string to enter into and be held by said smaller inner diameter portion of a pipe string. The lower element of the hanger comprises a tube which has an outer diameter substantially equalling that of the upper element tube and is fluid-tightly connected, near its upper end, to the bottom of a lower element surrounding sleeve. The lower element sleeve (a) has an inner diameter capable of fitting snugly, but slidably, around the outer diameter of a portion of the upper hanger element below the brass-like sleeve, and (b) near its mid-portion contains a plurality of lugs extending inwardly into slots in the upper element tube. The dimensions of the slots and lugs are arranged to accommodate the extent of the vertical travel induced by thermal expansion and contraction of the liner within the well in which it is to be installed. The hanger is provided with means for attaching it to the liner to be hung and a pipe string for lowering the assembly into a well.

DESCRIPTION OF THE INVENTION

Figure 1:
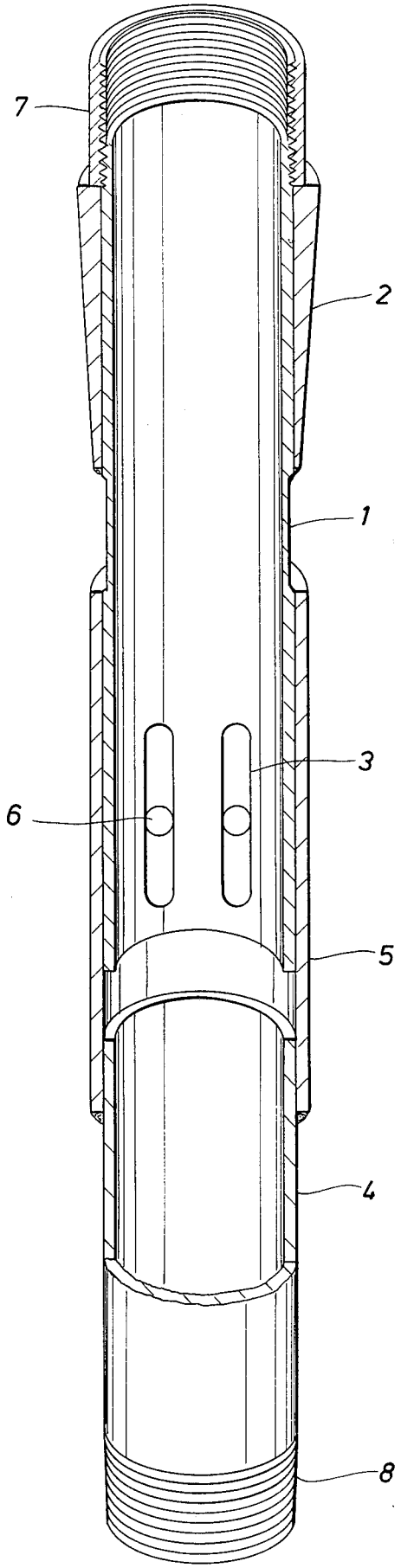
FIG. 1 shows a cross sectional view of the hanger of the present invention.

As shown in FIG. 1, the upper element of the hanger comprises a section of tubing 1 which is surrounded by a brass-like tapered sleeve 2 and is provided with a plurality of axially aligned slots 3. The lower element of the hanger is a section of tubing with a similar outer diameter which is fluid-tightly connected to a surrounding sleeve 5. The sleeve 5 has an inner diameter capable of fitting snugly, but slidably, around the outer diameter of the lower portion of the upper element of the hanger.

The gap between the inner diameter of the sleeve 5 and outer diameter of the element 1 are preferably machined to a close tolerance providing an opening which is not substantially larger than the perforations in the liner to be hung.

A threaded sleeve section 7 is arranged for connection to a lifting sub so that the hanger can be picked up and raised on the drill floor. The lower element of the hanger is provided with means, such as threaded section 8, adapting the hanger to be connected to the upper end of a liner.

The brass-like sleeve 2 has an outer diameter which tapers to a bottom portion small enough to enter into a reduced inner diameter enter into a reduced inner diameter portion of a pipe string, (such as a casing string). That portion is located so that it becomes positioned within the well at the depth at which the liner and hanger are to be installed. The outer diameter of the upper portion of the sleeve 2 is arranged to be too large to pass into the reduced inner diameter portion of the surrounding pipe string without being too large to pass through the upper portions of the surrounding pipe string.

Figure 2:
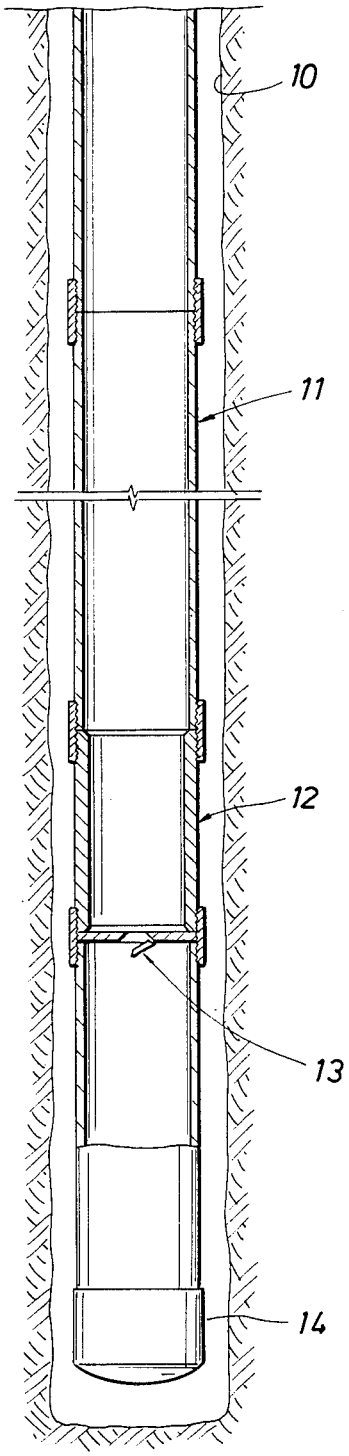
FIGS. 2–4 are schematic illustrations of different stages of completing a well containing a liner suspended from a hanger of the present invention.

FIG. 2 shows an early stage in a preferred procedure for installing the present hanger and a liner within a well. As shown, a borehole 10 has been drilled into the earth to a depth near, but above a reservoir interval within which a well liner is to be installed. The casing string 11 has been provided with a reduced inner diameter section 12, an insert for cementing 13, and a cement guide shoe 14. Such a casing string, or other pipe string, can readily be assembled from conventional units. The reduced inner diameter section 12 is preferably a section of pipe having a thicker wall but substantially the equal outer diameter. The insert for cementing and the cement guide shoe can be conventionally available items. Such a casing string can be cemented or otherwise grouted in place by means of materials and procedures which are conventionally known and available.

Figure 3:
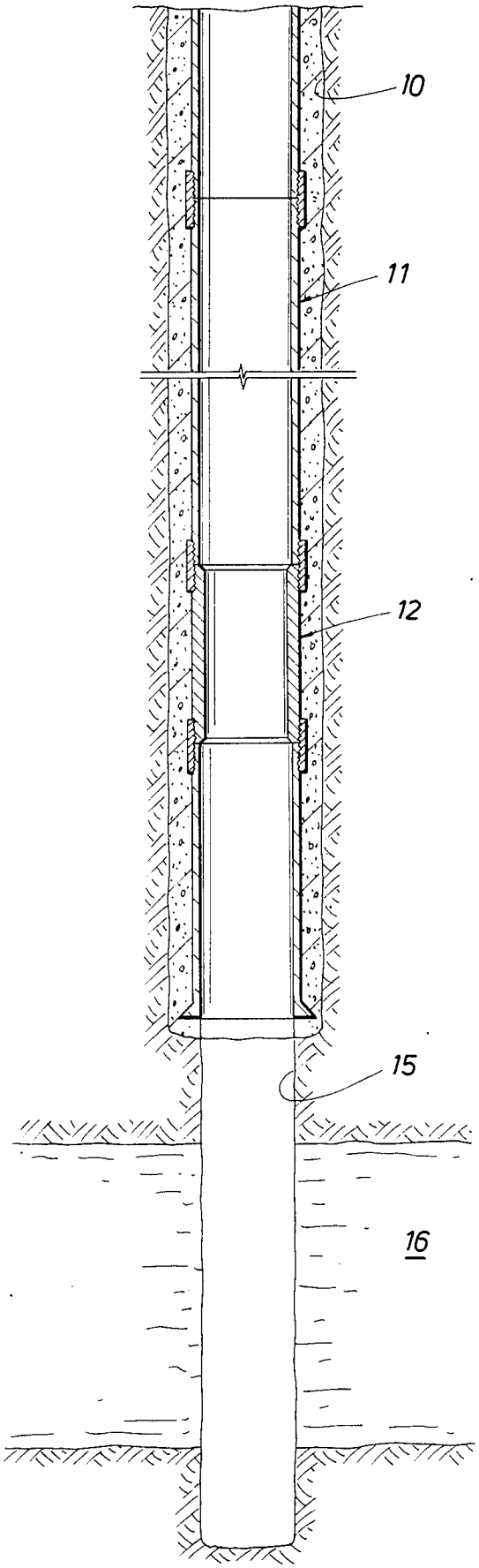

FIG. 3 shows a subsequent stage in which the pipe string has been grouted into the borehole and, preferably, cleaned out by means of running a scraper through the upper portion of the casing and the reduced diameter section 12. In general, a drill string is preferably run in to drill out the cement insert and shoe and extend a borehole section 15 on into a reservoir interval 16 in which the liner is to be located. However, by using a cement basket or the like, where desired, the well can be initially drilled to the depth necessary to accommodate the liner below the casing string.

Figure 4:
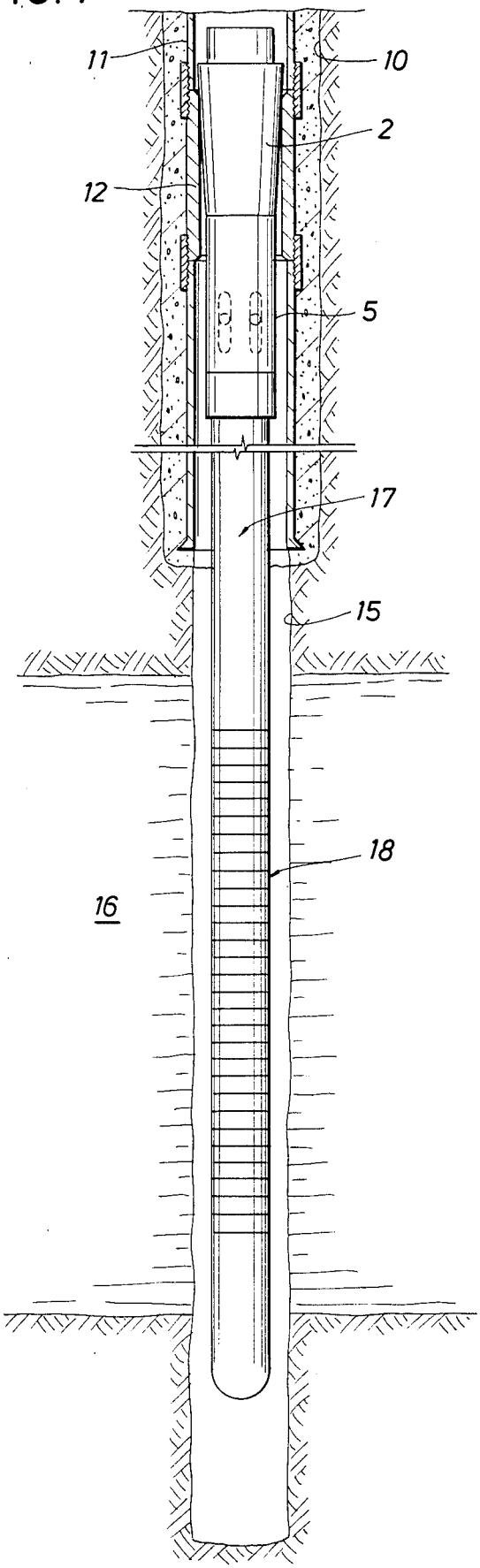

FIG. 4 shows the final stage of installing a well liner suspended from the present liner hanger. The brass-like sleeve 2 is wedged into the reduced diameter portion 12 of the surrounding pipe string 11 and the liner 18 is hung below the expansion joint provided by the sleeve 5 of the lower element of the hanger.

Figure 5:
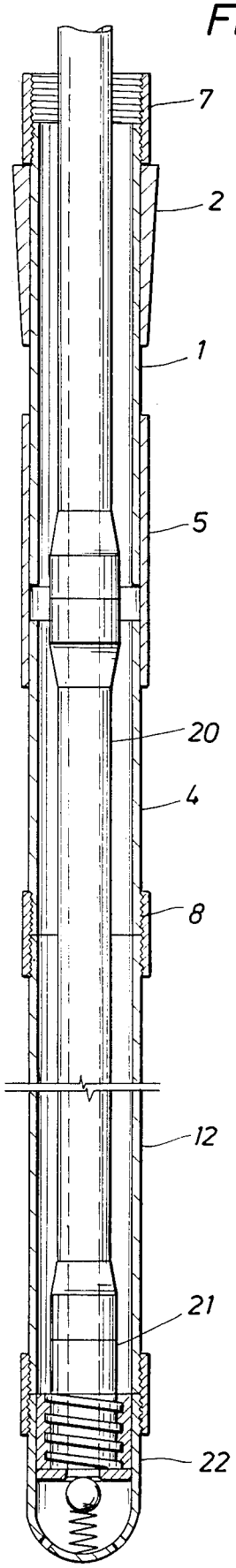
FIG. 5 schematically illustrates preferred means for attaching the present hanger to a liner and a running string.

FIG. 5 shows a preferred method of connecting the present liner hanger to a running string and the liner for installing the assembly. As shown, a running string 20 comprises a section of 3½-inch I.F. drill pipe which is connected below a 4½-inch X.O. drill pipe (not shown). The running string is bottomed by a running tube 21, such as a 3½-inch I.F. box on the top of 10 left-handed coarse threads (e.g. 2 per inch), such as Acme threads, on the bottom of the running tube. The bottom end of the liner is connected to washdown shoe 22 containing internal left-hand threads for receiving those on the bottom of the running string.

Field Test Example

A plurality of liner hangers of the present invention have been installed in an oil field in which the traditional well completion equipment involved a 100-foot wire-wrapped liner set on bottom with a lead seal arranged to seal the gap between a 7-inch liner and a 9⅝-inch production casing. It was found that when the lead seals became washed or eroded-out, rod pumps became less efficient and centrifugal pumps would shut down completely; necessitating the pulling of the wire wrapped liners and pumps and thus involving costs in the order of $6,000 per treatment.

A plurality of the present type adapters have been installed and successfully pressure tested at pressures ranging from 90 to 500 psi. The so-tested hangers were constructed as indicated in FIG. 1. In each case, the tapered brass sleeve 2 was constructed of brass composed of 70% copper and 30% zinc. Each sleeve had the following dimensions (in inches): length 12; inner diameter 7; top outer diameter 8.70; bottom outer diameter 7.90. The sleeves were passed through 9⅝-inch 36 lb. casing strings and wedged inside of 20-foot long sections of 9⅝-inch 53.5 lb. casing near the bottom of the strings.

The casing strings were run in and cemented as indicated in FIGS. 2 to 4. The hangers were each connected to a 200-foot wire wrapped screen liner. The hangers were sealed (as shown in FIG. 4) by pressing the brass tapers into the heavy wall pipe sections with the weight of the drill strings (amounting to about 30,000 lbs.). Since the casings were substantially vertical, the vertical force was about 30,000 lbs., and the horizontal force was about 100,000 lbs. Since brass of the type used yields at 20,000 psi, the minimum sealing surface was about 5 square inches, in the form of a metal-to-metal seal ring of about 0.2 inches wide. Even at a corrosion rate of 0.020 inches per year, such a seal should remain intact for about 10 years.

In each of the hangers tested, in the region just above the slots 3, the gap between the outer diameter of the upper hanger element 1 and the sleeve 5 was machined to 0.01 inches ±0.005 inches. The openings through the wire wrapped screens were 0.012 inches ±0.002 inches. Since experience has indicated that such wire wrapped screens are effective in keeping sand out of the wellbores, the tolerance between the element 1 and the sleeve 5 is expected to prevent the entry of sand between those elements.

Suitable Materials and Techniques

In general, the present hanger can be installed within substantially any metal pipe containing a properly proportioned section of reduced internal diameter and having a strength adequate to withstand the formation of a metal-to-metal seal by an application of a downward force on a brass-like sleeve. A preferred arrangement comprises a section of heavy walled casing having an inner diameter smaller than that of the rest of the casing by an amount sufficient to engage and hold a tapered sleeve, where the sleeve is small enough to pass through the rest of the casing and the smaller inner diameter is large enough to avoid blocking cement plugs and the like. For example, the inner diameter of 53.5 lb., 9⅝-inch heavy walled casing is 0.4 inches smaller than that of such a 36 lb. casing, and cement plugs such as Dowell's can pass through such a reduced diameter.

In a particularly preferred installation procedure, an insert for cementing, such as those commercially available, should be put on a 20-foot shoe joint below the heavy walled 9⅝-inch casing section, so the cementing plug can wipe the surface of the heavy walled section cleanly.

The term "brass-like, in relation to the sleeve 2, is used herein to refer to a metal having a combination of ductility, strength and corrosion resistance which is at least substantially as efficient for forming a corrosion resistant metal-to-metal seal as a brass sleeve composed of 70% copper and 30% zinc. In each of the hangers tested as described above, the seal between the brass-like tapered sleeve 2 and the upper element 1 of the hanger was formed by crimp-fitting the sleeve onto a piece of 7-inch, 23 lb. steel pipe. To ensure that the sleeve would not come off, the threaded collar means 7, for the accommodation of a lifting sub, was arranged to lock the sleeve in place.

What is claimed is:

1. In a well completion process in which a casing string is cemented within a well borehole above an oil productive interval, a permeable liner is installed within an extension of the borehole below the casing, an annular seal is installed between the liner and casing, and sand tends to enter the well to an extent tending to cause undesirable erosion of annular seals composed of materials as ductile as lead, an improvement for maintaining the efficiency of the annular seals comprising:

installing within said casing string a section of pipe which has an inner diameter smaller than those of the sections located above it and is positioned near, but above, the oil productive interval;

running the permeable liner to be used into the casing string and borehole extension with the upper end of the liner connected to a liner hanger which contains a tapered sleeve of brass-like metallic material attached around a tubular upper liner hanger element containing axially aligned slots which are penetrated by lugs estending inwardly from a sleeve which is (a) fluid-tightly connected to a tubular lower liner hanger element and (b) arranged to fit snugly, but slidably, over the tubular upper liner hanger element with the clearance between it and the upper tubular liner hanger element, being at least substantially as small as the openings within the permeable liner and said slots and lugs having dimensions arranged to accommodate the extent of vertical travel induced by thermal expansion and contraction of the liner within the well in which it is to be installed; and wedging the tapered sleeve of brass-like metallic material into the interior of the pipe string section of reduced diameter by subjecting said sleeve to weight from the liner running string to provide a downwardly directed force sufficient to press it downward into that section and deform the brass-like metallic material into a metal-to-metal seal ring of significant width.

2. The process of claim 1 in which the liner is run in on a pipe string coupled to the bottom of the permeable liner in order to maintain the maximum designed separation between the upper and lower portions of the tubular liner hanger elements during the hanging of the liner.

3. The process of claim 1 in which the brass-like metallic material has a combination of ductility, strength and corrosion resistance which is at least substantially as effective for forming a corrosion-resistant metal-to-metal seal as a brass sleeve composed of seventy percent (70%) copper and thirty percent (30%) zinc.

4. The process of claim 1 in which the casing string pipe section of reduced inner diameter is a section which has an outer diameter substantially equalling that of the other sections of the casing string but has a wall thickness significantly greater than the other sections of the casing string.

* * * * *